United States Patent [19]

Sims

[11] Patent Number: 4,979,734

[45] Date of Patent: Dec. 25, 1990

[54] MILTI-PURPOSE HYDRAULIC EXERCISE APPARATUS

[76] Inventor: Anthony M. Sims, P.O. Box 371, Murray Bridge, South Australia, 5253, Australia

[21] Appl. No.: 416,063

[22] Filed: Oct. 2, 1989

[30] Foreign Application Priority Data

Oct. 6, 1988 [AU] Australia ..... PJ0785

[51] Int. Cl.[5] ..... A63B 21/08

[52] U.S. Cl. ..... 272/130; 272/134

[58] Field of Search ..... 272/130, 134, 143, 144

[56] References Cited

U.S. PATENT DOCUMENTS

| | | | |
|---|---|---|---|
| 3,495,824 | 2/1970 | Cuinier | 272/130 |
| 4,407,496 | 10/1988 | Johnson . | |
| 4,576,377 | 3/1986 | Wolff | 272/120 |
| 4,634,127 | 1/1987 | Rockwell | 272/134 |
| 4,645,205 | 2/1987 | Wolff | 272/130 X |
| 4,792,135 | 12/1988 | Chin-Sen | 272/134 |
| 4,834,396 | 5/1989 | Schniell | 272/134 X |

FOREIGN PATENT DOCUMENTS 3155989 9/1989 Australia .

OTHER PUBLICATIONS

Orthotron operating and positioning handbook, seven pages (date unknown).

Johnson Anti-Shear Accessory trade literature, Cybex 1983, one double-sided page.

*Primary Examiner*—Robert Bahr

*Attorney, Agent, or Firm*—Baker, Maxham, Jester & Meador

[57] ABSTRACT

Exercise equipment wherein a number of exercises can be performed, and wherein there is provided a frame having a base platform for standing and a seat which is movable between a forward and a rearward position. A long arm is provided with a handle at one end, and a short arm with leg engaging rollers at one end of the short arm, both arms being carried by a rotatable shaft coupled to an hydraulic pump. The height of the pump is adjustable.

8 Claims, 3 Drawing Sheets

MILTI-PURPOSE HYDRAULIC EXERCISE APPARATUS

This invention relates to hydraulic exercise means comprising equipment which can be used for a variety of exercises.

BACKGROUND OF THE INVENTION

Although some multiple exercise equipment is in common use, in most instances special purpose machines are provided for specific exercises. This applies in some instances where the exercises required are for biceps, triceps, upright row, push down, squat, bench press, shoulder and lateral pull-down, leg extension, leg curl, and abdominal and hypotension exercises.

PRIOR ART

Much prior art exists wherein the axis of a semi-rotary pump can be adjusted in height to reduce "shear" forces acting on the joint of a patient or gymnast which will exist if the axis of that joint is not coincident with the pump axis. Specifically, one can refer to the ORTHOTRON hand book which clearly illustrates the adjustable pump which is aligned with axis of rotation of a joint.

The Johnson U.S. Pat. No. 440,7496 relates to an adjustable dual pad accessory which allows selection of counterforce required to control anterior shear during knee extension. It is described as being usable with the ORTHOTRON equipment. It is used in conjunction With a semi-rotary pump the axis of which can be adjusted by means which are a mechanical equivalent of a telescopic post.

Reference can also be made to an Australian Pat. application No. 31559/89 in the name of Titan Fitness Products Pty. Ltd. While the equipment disclosed in that specification constituted a major advance over previous art known to the Applicant, the equipment required the use of several separate ancillary pieces to achieve all forty exercises referred to in that specification.

It is an object of this invention to provide a simple exercise means capable of being used for at least twelve separate exercises without the need for ancillary pieces. Those twelve separate exercises may include the more commonly used exercises of the abovementioned forty exercises.

BRIEF SUMMARY OF THE INVENTION

In this invention there is provided a simple and effective piece of exercise equipment wherein at least the above identified exercises can be performed, and in one embodiment of the invention there is provided a frame having a base platform for standing, a seat which is movable between a forward and a rearward position, a long arm having a handle at one end, and a short arm having leg engaging means at one end of the short arm, both arms being carried by a rotatable shaft coupled to an hydraulic pump, and height adjustment means for adjusting the pump height.

The short arm coupled to the hydraulic pump shaft has little influence on the effectiveness or resistance to movement of the long arm, but the reverse is not true, and in one embodiment of the invention there is provided quick release means which will quickly disengage the long arm from the pump shaft.

A difficulty in obtaining appropriate location of the pump axis for both knee and hip joints, is the need to reposition a seat with respect to the pump. Another difficulty is to provide means whereby the long arm can be used from the front end as well as the rear end of the equipment. These difficulties are overcome in an embodiment of this invention by having an upwardly and rearwardly sloping telescopic post carrying the pump.

More specifically, the invention consists of an exercise equipment comprising a frame having a front end and a rear end, a base platform on the front end of the frame located to support a user in a standing posture, said base platform having a rear end, the frame comprising a post having two elements and sloping upwardly and rearwardly from a locality near the rear end of the base platform, retention means retaining the elements adjustably for position, an hydraulic pump on the upper end of the post and having a rotatable shaft, a short arm, and a long arm both carried on the shaft, a seat adjacent said rear end of the base but located to one side thereof, and adjustment means operatively supporting the seat from the frame for adjustment of seat position in a forward and rearward direction.

BRIEF DESCRIPTION OF THE DRAWING

An embodiment of the invention is described hereunder with reference to and is illustrated in the accompanying drawings, in which.

DETAILED DESCRIPTION OF THE PREFERRED EMBODIMENT

Figure 5:
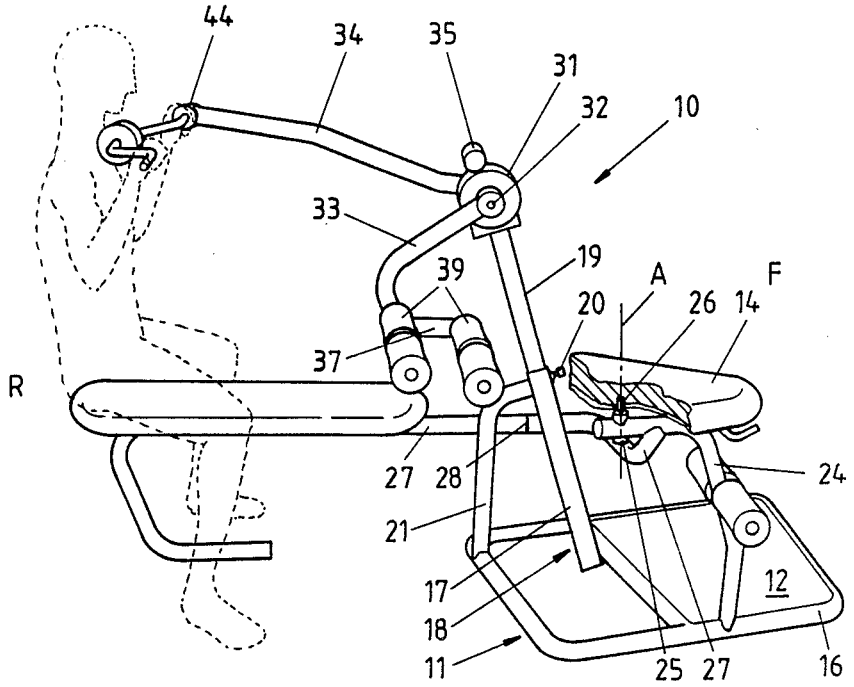
FIG. 5 shows a forwardly facing user seated on a bench at the rear-end of the exercise means, performing shoulder press and lateral pull-down exercises.

In this embodiment, a multiple piece of exercise equipment 10 comprises a frame 11 having a front end F and a rear end R, the frame 11 supporting a base platform 12, an elevated elongate platform 13 to support a user lying down, or sitting as shown in FIG. 5, and a seat 14.

The base platform 12 supports a user in a standing posture, and is carried by a rectangular frame portion 16 which supports intermediate its ends an upwardly and forwardly sloping outer element 17 of a telescopic post 18 which is formed from square section tubing and telescopically supports an inner element 19 by an amount which can be varied, adjustment being retained by a clamping screw 20 (FIG. 5). Alternatively, use can be made of a pin insertable selectively in holes in the inner element 19 to provide height adjustment. The outer element 17 is stiffened by a strut 21 upstanding from the rear end of the rectangular frame portion 16.

Figure 3:
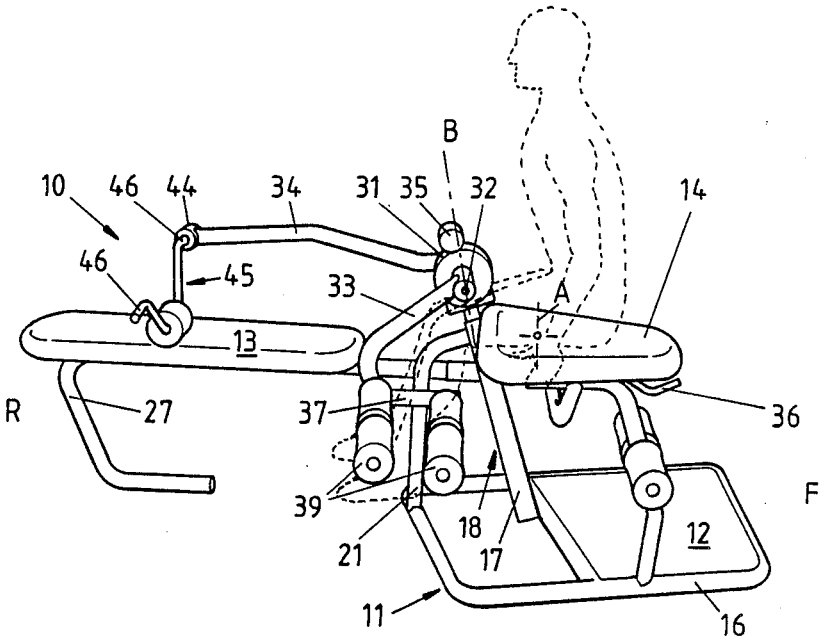
FIG. 3 shows a rearwardly facing user seated on the seat, when positioned as shown in FIG. 2, and performing the leg extension and leg curl exercises.
Figure 4:
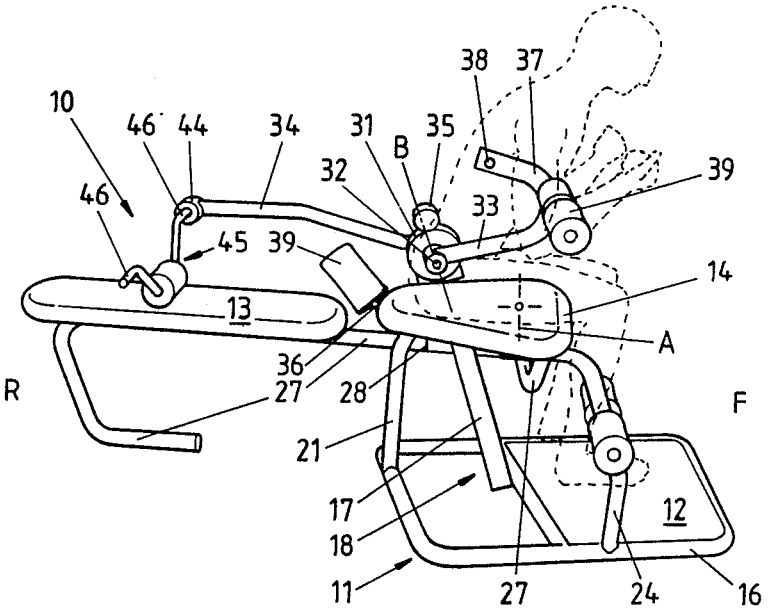
FIG. 4 shows the seat directed rearwardly but supporting a forwardly facing user performing abdomen and lower back development exercises.

A seat support stem 24 is upstanding from one side of the frame portion 16, and this includes a bush 25 which carries a spindle 26 which depends from seat 14, so that the seat 14 can rotate about axis A to either face rearwardly as shown in FIG. 3 or forwardly as shown in FIG. 4. Axis A is closer to one end of the seat than the other, so that rotation by 180° effectively adjusts the seat 14 in a forward and rearward direction.

The seat support stem 24 is further coupled to a rearwardly extending frame portion 27 which is of 'L' shape in plan and which supports the elongate platform 13 The rearwardly extending frame 27 is provided with a spigot and socket joint at 28 by which it can be "broken" to facilitate packaging of the equipment.

One of the difficulties which has been encountered heretofore with hydraulic equipment has been the presence of hydraulic hoses between various elements of the equipment and adjustment valves which adjust the pressure of fluid being displaced, and thereby in turn the amount of force required to cause actuation of the hydraulic pump. In this invention however, the upper end of the post 18 has an hydraulic pump 31 fixed thereto, and the pump 31 is provided with a rotary shaft 32, one end of the shaft 32 carrying on it a short arm 33 and the other end carrying on it a long arm 34. The pump is of the semi-rotary type and is the subject of Australian patent application PJ 3989, and has secured to its upper end a valve and reservoir assembly 35 which is quickly adjustable to vary the pressure for rotation in a clockwise or counter-clockwise direction.

The short arm 33 has an end 37, the end 37 containing a pair of bushes 38 (FIG. 4) into which the axles of a pair of respective spaced resilient rollers 39 can be inserted, the rollers 39 being arranged to be engaged by the legs of a user when the arm 33 is in the position shown in FIG. 3. As illustrated in FIG. 3, a user is using the short arm facility for leg extension and leg curl, and as it can be seen, the seat 14 is disposed forwardly and axis 'B' of rotation of shaft 32 is coincident with the pivotal axis of a user's knee joints.

As illustrated in FIG. 4, the user is again using the short arm facility by utilising one of the rollers 39 in the end of the short arm 33, so that it can be raised against the pressure imparted by pump 31 for performing abdomen and lower back development exercises. The other roller 39 is positioned on spigot 36 at an end of seat 14, and provides a means to limit backward movement of a user. Alternatively use can be made of straps (not shown) coupled to the short arm, for abdomen and hypotension exercises. The seat 14 has been rotated 180° from its forward direction (FIG. 3) to its rearward direction.

Figure 6:
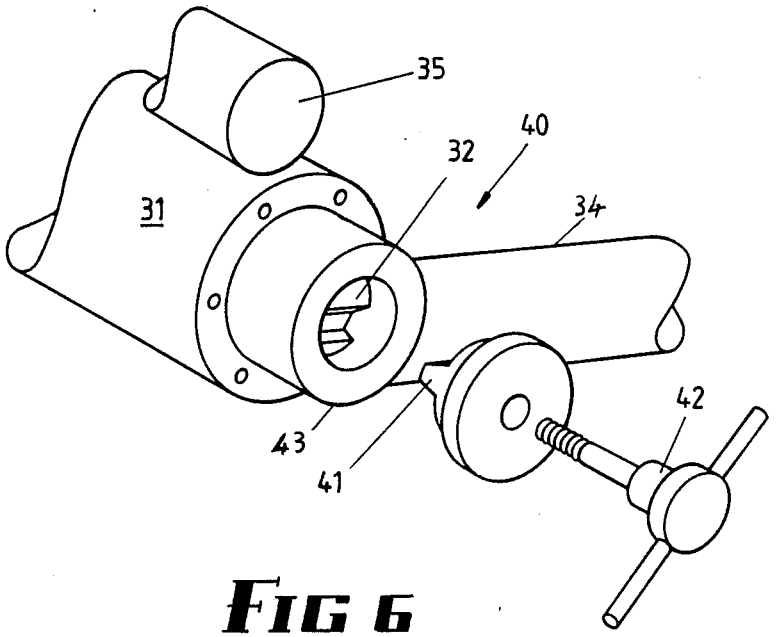
FIG. 6 shows the dog clutch arrangement for engagement or disengagement of the long arm.

When the short arm facility is being used as in FIGS. 3 or 4, the long arm 34 is disconnected from the shaft 32 of the pump 31 by means of a dog-clutch 40 (FIG. 6) having an axially movable sloping sided dog 41 which is welded into boss 43, and which engages in a slot in the end of shaft 32 only when screwed in by means of a hand screw 42, but otherwise the sloping wall of dog 41 urges it axially outwardly. Thus in FIGS. 3 and 4, the long arm 34 merely rests upon platform 13.

When the screw 42 is screwed inwardly, the arm 34 can be made to overlie the elongate platform 13 so that the user can perform bench presses as shown in FIG. 5. In that mode, shoulder presses and lateral pulldown exercises can also be performed. Since the post 18 slopes, the pump shaft 32 is translated rearwardly as the post extends upwardly to move to a central position between platforms 12 and 13.

Figure 2:
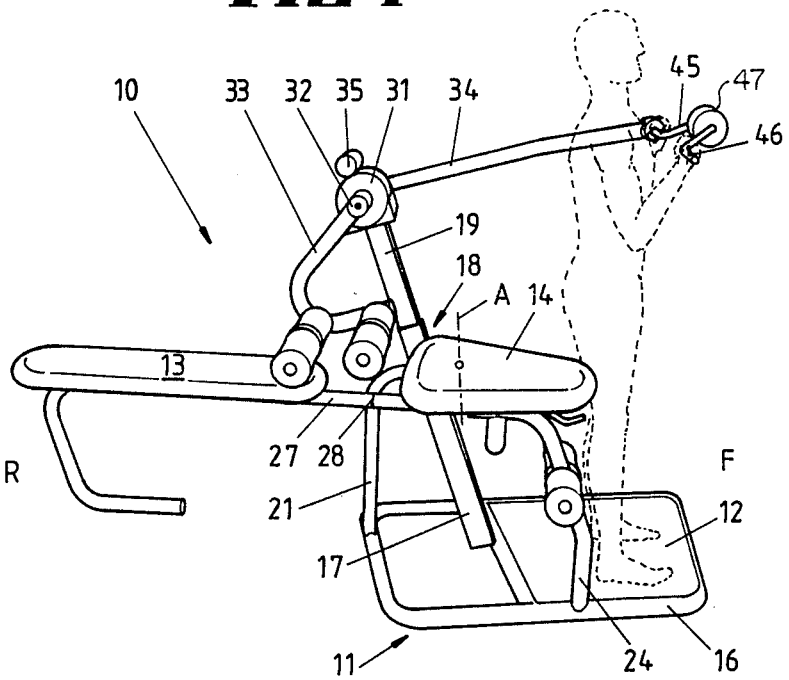
FIG. 2 is a perspective side elevation, showing in dotted lines, a user facing forwardly and performing bicep-tricep exercises, and showing the seat directed in a "forward" direction wherein a user can utilise the equipment for leg extension and leg curl exercises.

If the long arm is swivelled around approximately 180° from the position shown in FIG. 5, it will overlie the base platform 12, and a user can stand on platform 12 and move the arm 34 up and down for the biceps, triceps, upright row, push down and squat exercise, and this is illustrated in FIG. 2.

Figure 1:
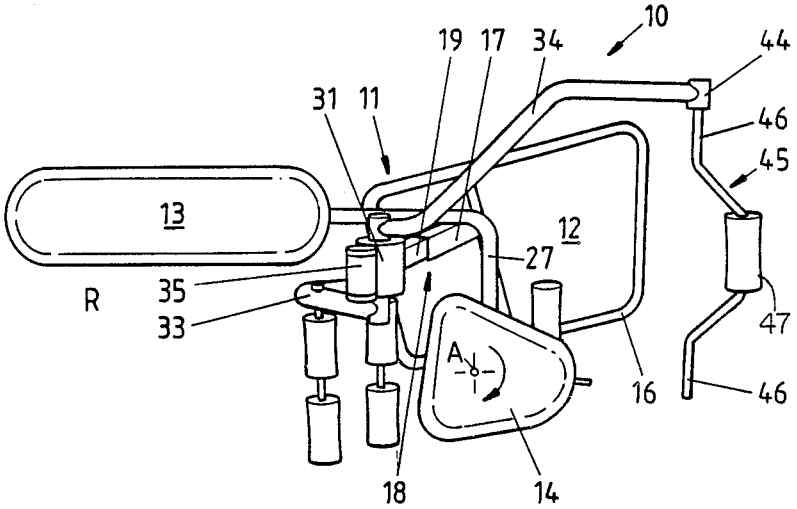
FIG. 1 is a perspective plan view of the exercise means of this invention.

As best seen in FIG. 1, the end of long arm 34 has a bush 44 into which a cranked rod 45 slides, the rod 45 having two coaxial ends 46, and a roller 47 on the intermediate portion, and this facilitates grasping with the hands without interference by the head during the squat and bicep-tricep exercises. For packaging purposes, it is merely necessary to slide out the elongate platform at the spigot joint 28, lift off the seat, and remove the long handle.

I claim:

1. Exercise equipment comprising:

a frame having a front end;

a base platform on the front end of said frame positioned to support a user in a standing posture, said base platform having a rear end;

a two-element height adjustable post mounted to said frame and sloping upwardly and rearwardly from a location adjacent the rear end of said base platform;

a hydraulic pump on the upper end of said post, said pump having a rotatable shaft;

a short arm and a long arm coupled to and rotatable with said shaft;

a seat support stem mounted to said frame and extending upwardly from one side of said base platform;

a bush in an upper end of said seat support stem;

a seat positioned adjacent said rear end of said base platform and to one side thereof; and seat adjustment means operatively supporting said seat on said frame selectively adjustably oriented in a forward or a rearward direction;

said seat adjustment means comprising a depending spindle engaged with said bush so that said seat is rotatable with respect to said bush, said spindle being closer to one end of said seat than the other so that rotation of said seat by 180 degrees effectively adjusts the position of said seat.

2. Exercise equipment according to claim wherein said rotatable shaft extends beyond both sides of said hydraulic pump, said short arm being on the same side of the frame as the seat, said long arm being on the opposite side of the hydraulic pump from the short arm, said frame also having a rearwardly extending frame portion and an elevated elongate platform carried by that portion, a clutch between the rotatable shaft and the long arm, and locking means co-operable between the pump shaft and an end of the long arm which can selectively lock the long arm in a first position overlying the base platform or a second position overlying the elevated elongate platform.

3. Exercise equipment comprising:

a frame having a front end;

a base platform on the front end of said frame positioned to support a user in a standing posture, said base platform having a rear end;

a two-element post mounted to said frame and sloping upwardly and rearwardly from a location adjacent the rear end of said base platform;

a hydraulic pump on the upper end of said post, said pump having a rotatable shaft with ends extending beyond both sides of said hydraulic pump;

a short arm and a long arm coupled to and rotatable with said shaft;

a seat positioned adjacent said rear end of said base platform and to one side thereof, said short arm being on the same side of said frame as said seat;

seat adjustment means operatively supporting said seat on said frame selectively adjustably oriented in a forward or a rearward direction;

a pair of rollers releasably retained on said short arm near an end thereof, said short arm being movable with said shaft between a lower position rearward of said seat where said rollers are engageable by the legs of the user when seated on said set and facing rearwardly, and an upper position where said short arm overlies said seat and one of said rollers is engageable by the arms of a user when seated on said seat and facing forwardly.

4. Exercise equipment according to claim 3 and further comprising a spigot projecting from an end of the seat, a said roller when removed from the short arm being releasably retainable on the spigot to provide limit means which limit backward movement of a user when seated on the seat and facing forwardly.

5. Exercise equipment comprising a frame having a front end and a rear end, a base platform on the front end of the frame located to support the user in a standing posture, said base platform having a rear end, the frame having a height adjustable post comprising two elements and sloping upwardly and rearwardly from a locality near the near end of the base platform, retention means for adjustably retaining the elements on the frame, the frame also having a rearwardly extending frame portion and an elevated elongate platform carried by that portion, said frame further having a seat support stem upstanding from one side of the base platform, a bush in an upper end of the seat support stem, a seat adjacent said rear end of the base, the seat having adjustment means comprising a depending spindle which is carried by the bush such that the seat can rotate with respect to the bush, the spindle being closer to one end of the seat than the other such that said rotation of the seat by 180° effectively adjusts the seat position between a forward and a rearward direction, and a hydraulic pump on the upper end of said post and having a rotatable shaft, a short arm, and a long arm, both said short and long arms being carried on the shaft.

6. Exercise equipment comprising a frame having a front end and a rear end, a base platform on the front end of the frame located to support a user in a standing posture, said base platform having a rear end, the frame having a height adjustable post having two elements and a sloping upwardly and rearwardly from a locality near the rear end of the base platform, retention means for adjustably retaining the elements on the frame, the frame also having a rearwardly extending frame portion, and an elevated elongate platform carried by that portion, a hydraulic pump on the upper end of the post and having a rotatable shaft, a short arm, and a long arm, both the short and long arms being carried on the shaft, and a seat adjacent said rear end of the base but located to one side thereof, support means supporting the seat from the base and adjustment means between the support means and seat for adjustment of seat position between a forward and a rearward position, the rotatable shaft extending beyond both sides of said hydraulic pump, said short arm being on the same side of the frame as the seat, and a pair or rollers releasably retained by said short arm near an end thereof, the short arm being movable with the shaft between a lower position where it is rearward of the seat and the rollers are engageable by the legs of a user when seated on the seat and facing rearwardly, and an upper position where it overlies the seat and one of the rollers is engageable by the arms of a user when seated on the seat and facing forwardly.

7. Exercise equipment according to claim 6 further comprising a spigot projecting from an end of the seat, a said roller when removed from the short arm being releasably retainable on the spigot to provide limit means which limit backward movement of a user when seated on the seat and facing forwardly.

8. Exercise equipment comprising a frame having a front end and a rear end, a base platform on the front end of the frame located to support a user in a standing posture, said base platform having a rear end, the frame having a height adjustable post having two elements and sloping upwardly and rearwardly from a locality near the rear end of the base platform, retention means for adjustably retaining the elements on the frame, the frame also having a rearwardly extending frame portion, and an elevated elongate platform carried by that portion, a hydraulic pump on the upper end of the post and having a rotatable shaft, a short arm, and a long arm, both the short and long arms being carried on the shaft, and a seat adjacent said rear end of the base but located to one side thereof, support means supporting the seat from the base and adjustment means between the support means and seat for adjustment of seat position between a forward and a rearward direction, an end of said long arm comprising a cranked rod extending to one side thereof, the ends of the cranked rod being coaxial, and a roller rotatable about an intermediate portion of the rod between those ends and having an axis of rotation parallel to but spaced from said coaxial ends.

* * * * *

UNITED STATES PATENT AND TRADEMARK OFFICE

CERTIFICATE OF CORRECTION

PATENT NO. : 4,979,734

DATED : December 25, 1990

INVENTOR(S) : Anthony M. Simms

It is certified that error appears in the above-identified patent and that said Letters Patent is hereby corrected as shown below:

On the title page, in the title, change "MILTI" to --MULTI--.

Column 1, line 1, change "MILTI" to --MULTI--;

line 26, change "440,7496" to --4,407,496--.

Column 4, line 46, change "claim wherein" to --claim 1 wherein--.

Column 5, line 33, change "near" to --rear--.

Signed and Sealed this

Twenty-first Day of July, 1992

*Attest:*

DOUGLAS B. COMER

*Attesting Officer*

*Acting Commissioner of Patents and Trademarks*